US011015307B1

(12) United States Patent
Crites

(10) Patent No.: US 11,015,307 B1
(45) Date of Patent: May 25, 2021

(54) ROAD PENETRATION AND EXCAVATION SYSTEM

(71) Applicant: Michael Crites, Delphos, OH (US)

(72) Inventor: Michael Crites, Delphos, OH (US)

( * ) Notice: Subject to any disclaimer, the term of this patent is extended or adjusted under 35 U.S.C. 154(b) by 230 days.

(21) Appl. No.: 16/406,191

(22) Filed: May 8, 2019

(51) Int. Cl.
*E01C 23/09* (2006.01)
*E02F 3/88* (2006.01)

(52) U.S. Cl.
CPC ..... *E01C 23/094* (2013.01); *E02F 3/88* (2013.01)

(58) Field of Classification Search
CPC ..... E01C 9/094; E01C 9/128; E01C 23/094; E01C 23/128; E02F 3/88
See application file for complete search history.

(56) References Cited

U.S. PATENT DOCUMENTS 4,262,966 A 4/1981 Bouplon
4,683,684 A * 8/1987 Yie ..... E01C 23/0906 239/754
4,968,101 A 11/1990 Bossow
5,470,131 A * 11/1995 Nolan ..... E01C 23/094 299/41.1
5,803,661 A 9/1998 Lemelson
6,464,020 B1 * 10/2002 Wills ..... E01C 23/094 173/31
7,494,191 B1 * 2/2009 Crites ..... E02D 29/1445 125/13.03
7,644,523 B2 1/2010 Buckner
7,740,415 B1 * 6/2010 Crites ..... E02D 29/1445 404/94
8,011,851 B1 9/2011 Crites
8,096,367 B2 * 1/2012 McGivery ..... E01C 23/094 172/25
8,646,847 B2 * 2/2014 Cochran ..... E02D 29/1445 299/39.4
9,816,250 B2 * 11/2017 Maybury ..... E02F 3/8816
10,280,573 B1 * 5/2019 Knapp ..... E01C 23/094
10,801,265 B1 * 10/2020 Russo ..... E21B 41/0021
2003/0007835 A1 * 1/2003 Jurshak ..... E01C 23/094 404/72
2009/0064544 A1 * 3/2009 Rajewski ..... E02F 3/88 37/403
2010/0095559 A1 4/2010 Buckner

FOREIGN PATENT DOCUMENTS

WO WO 2013/027754 A1 * 2/2013

* cited by examiner

*Primary Examiner* — Gary S Hartmann
(74) *Attorney, Agent, or Firm* — Harpman & Harpman

(57) ABSTRACT

A street and road surface penetration removal system for utility repairs and replacement. The penetration and removal system utilizes a circular disk pavement cutter and remover with a retainment box placement for vacuum excavation using high pressure water excavation and vacuum removal by a self-contained excavation vacuum to gain clear access to a utility for repair or replacement.

9 Claims, 7 Drawing Sheets

ROAD PENETRATION AND EXCAVATION SYSTEM

BACKGROUND OF THE INVENTION

1. Technical Field

This invention relates to road surface removing machines that have been developed to remove a paved roadway surface by sawing, impacting, milling and direct excavation equipment with repairs to underground utilities. Such machines and combination of traditional excavation equipment typically requires multiple time-consuming steps involving the cutting, breaking up and removing of the paved surface then excavating with a backhoe down to the utility for repair.

2. Description of Prior Art

Such prior art excavation therefore required on site piling or removal of the excavation debris from the site.

Examples of combined excavation machines can be seen in U.S. Pat. Nos. 4,262,966, 4,968,101, 5,803,661, 7,644,523 and U.S. Publication 2010/0095559.

U.S. Pat. No. 4,262,966 discloses a roadway surface removing machine having a rotating drum cutting head to break up and the surface and a vacuum to remove the debris.

U.S. Pat. No. 4,968,101 claims a vertical asphalt and concrete miller with rotating cutting head to cut the surface around a manhole for removal and replacement.

U.S. Pat. No. 5,803,661 illustrates a pot hole repair device utilizing abrading the surface of the pothole then removing debris by a vacuum so a filler patch can be applied.

U.S. Pat. No. 7,644,523 shows a mobile vacuum boring and excavation method having a vacuum container with a vacuum source and a hose that removes material from the boring head.

Applicant's own U.S. Pat. No. 8,011,851 on a manhole cutting and removal device is used in the present road penetration and excavation system having a rotating annular disk assembly with multiple depending cutters that cut a circle "donut" of pavement around the manhole and remove it. The U.S. Pat. No. 8,011,851 is hereby incorporated by reference in its entirety.

Patent Publication 2010/0095559 discloses a mobile vacuum excavation attachment for a vehicle.

SUMMARY OF THE INVENTION

An integrated pavement penetration and excavating system using a modified adjustable diameter pavement disk cutter of U.S. Pat. No. 8,011,851 for cutting a pavement "donut" which is engaged by a lifting device for excavation surface access. An extendable annular retainment box is used within the opening with a hydro high-pressure excavator and a mobile vacuum hose for removal and excavation the defined pavement opening while the wall retainment box is extended in sections, as needed.

DETAILED DESCRIPTION OF THE INVENTION

Figure 1:
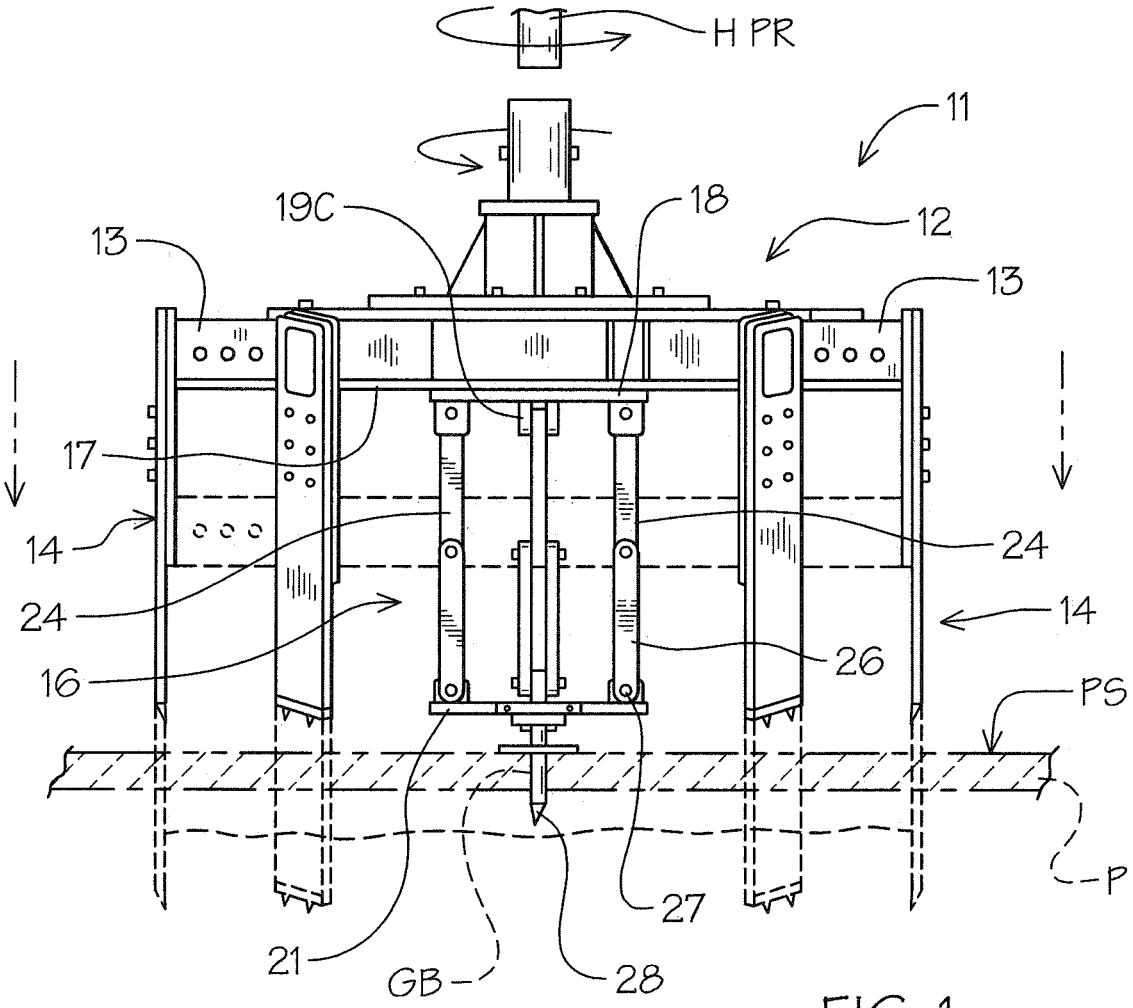
FIG. 1 is a side elevational view of a modified pavement cutter of the excavation system of the invention.
Figure 2:
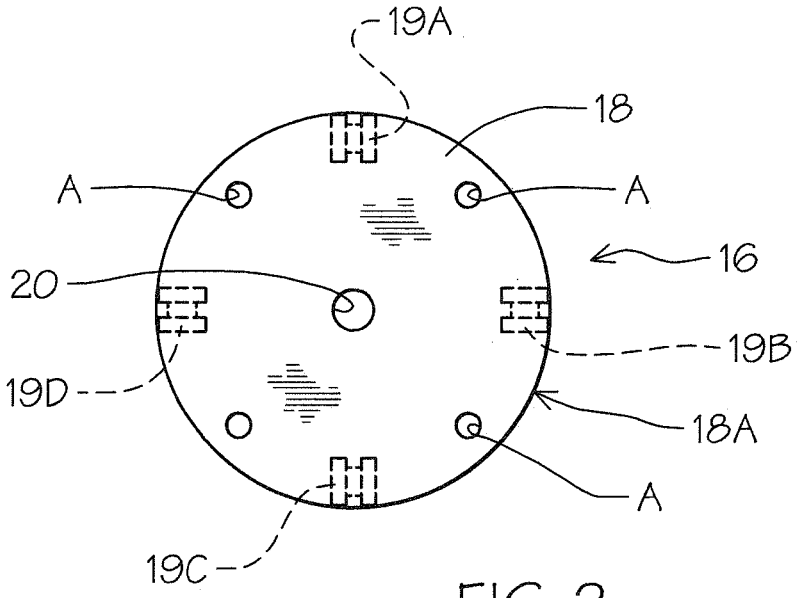
FIG. 2 is a top plan view of a modified cutter centering and guide device thereon.
Figure 3:
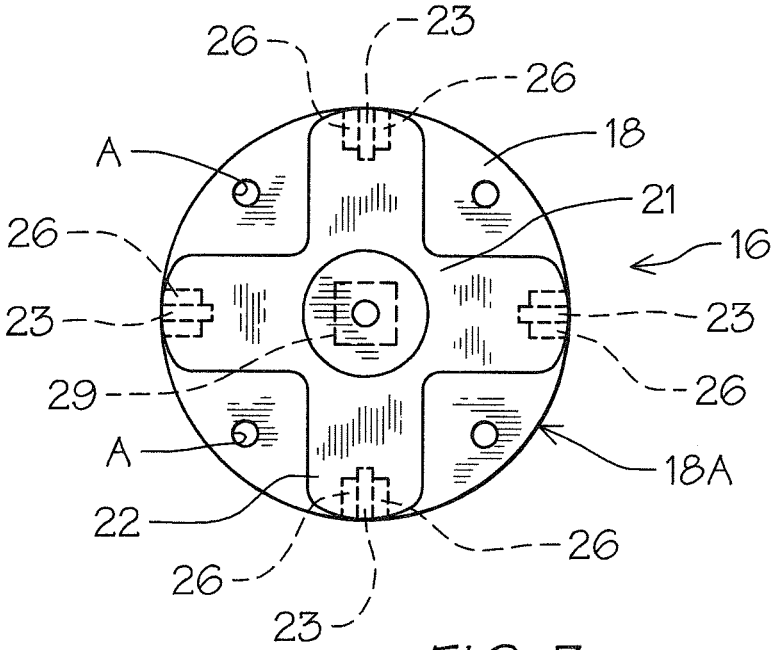
FIG. 3 is a bottom plan view thereof.
Figure 10:
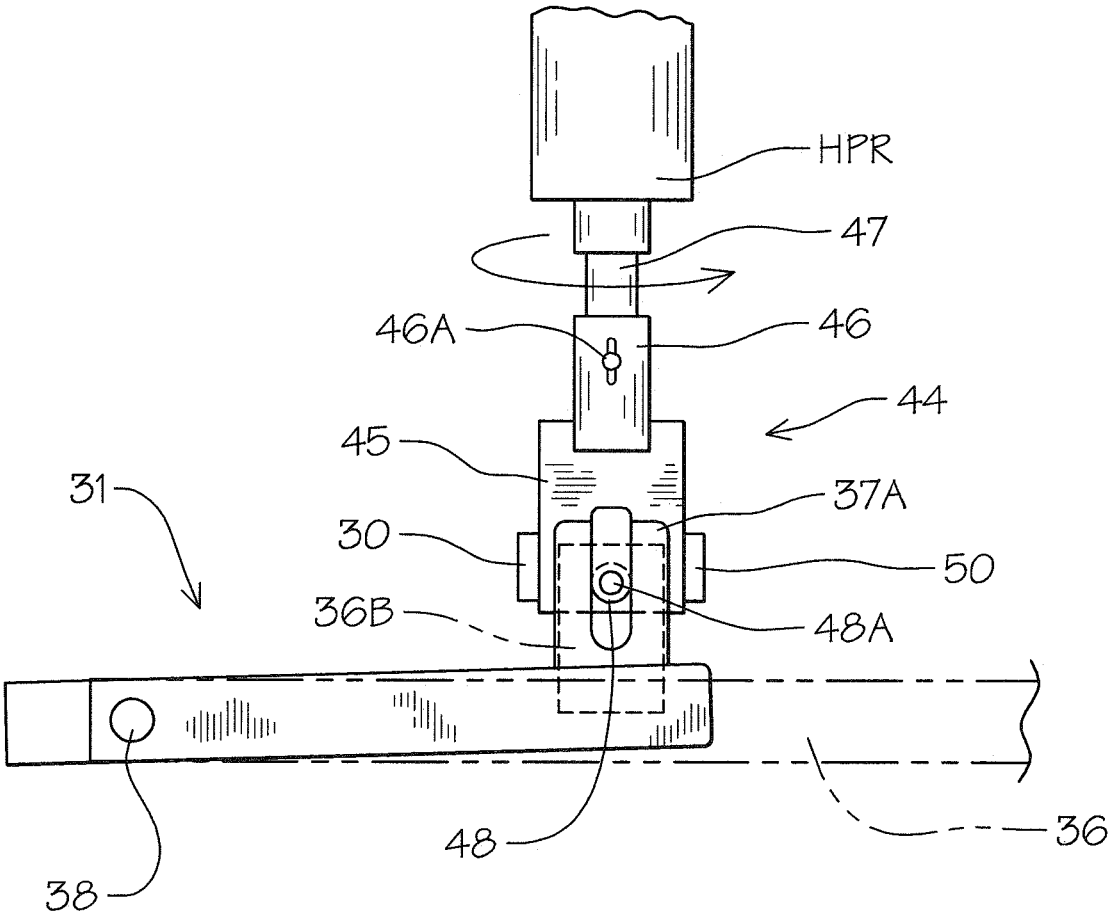
FIG. 10 is a side elevational graphic view of the bracket engagement hook and rotator assembly engaged on a lifting bracket.
Figure 11:
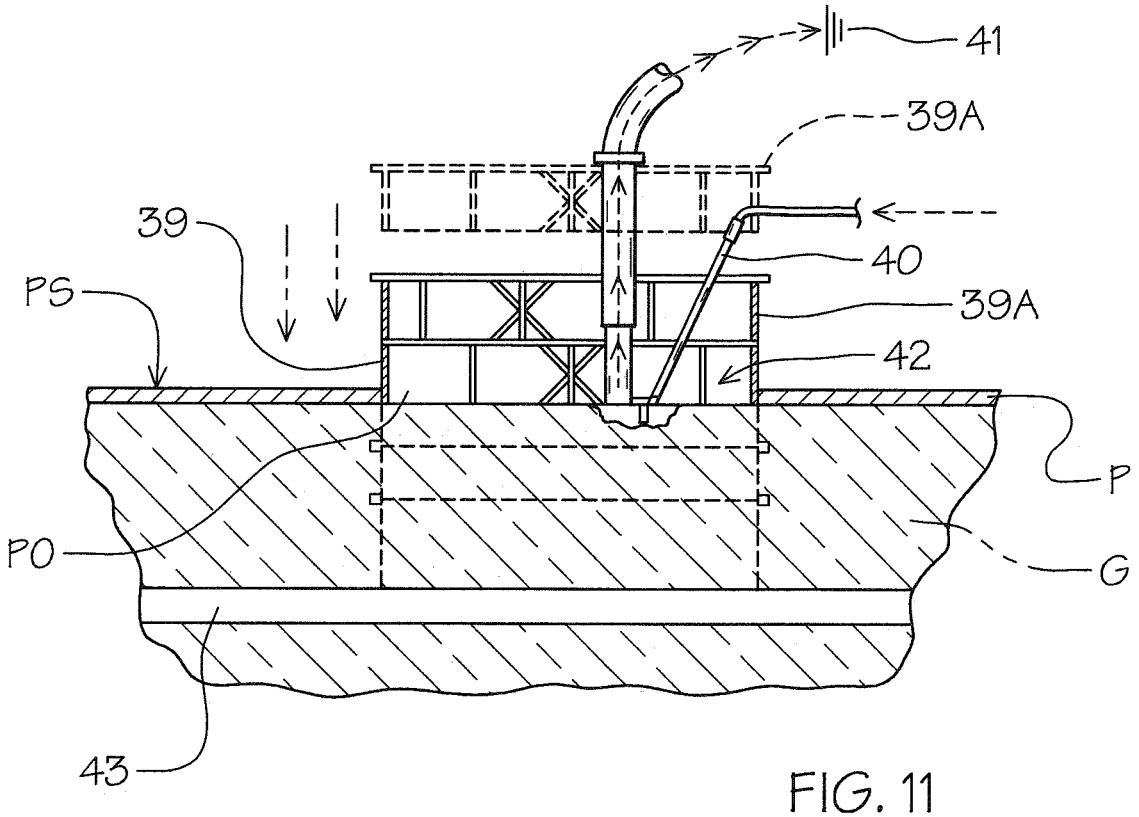
FIG. 11 is a side elevational representation of an annular retainment box and excavation and debris removal elements therewith.
Figure 12:
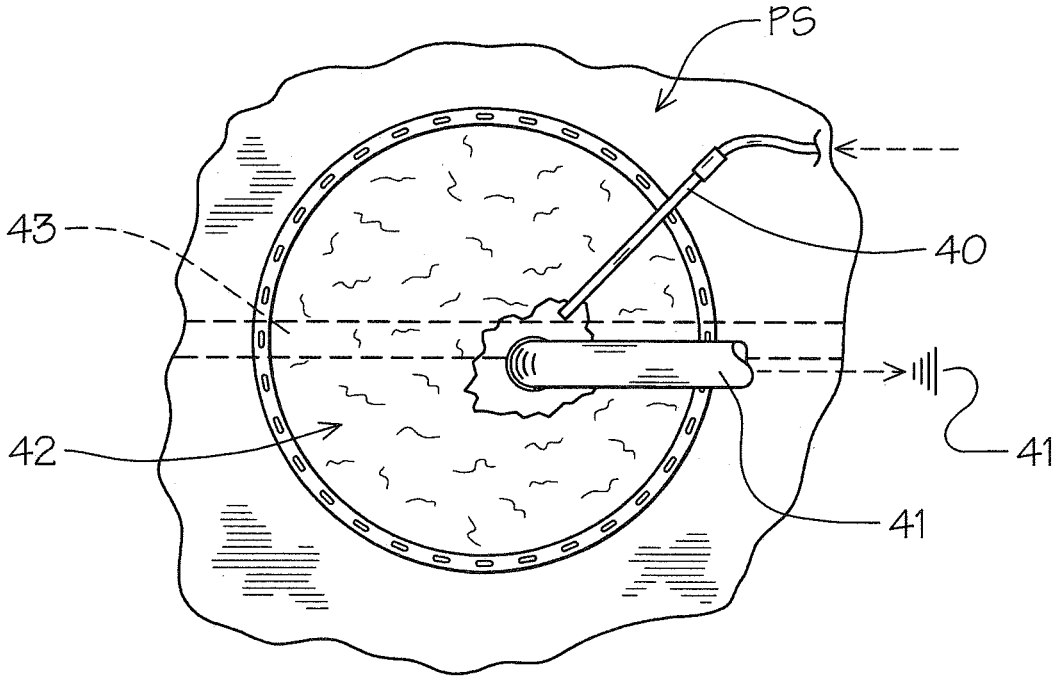
FIG. 12 is a top plan view thereof.

A road surface excavation system of the invention can be seen in FIGS. 1-8 of the drawings having a pavement cutter 11, best seen in FIG. 1 of the drawings. The pavement cutter 11 is based on the manhole cutter and removing device disclosed and described in applicant's U.S. Pat. No. 8,011,851 which is hereby incorporated by reference in its entirety herewith. The pavement cutter 11 has a circular disk assembly 12 with multiple adjustable pavement cutter arms 13 that will determine the diameter of the cut, each of the arms with a depending cutting blade assembly 14. The pavement cutter 11 is rotatably driven by a hydraulic power rotator HPR as seen in FIG. 10 of the drawings and is progressively lowered into engagement with the pavement thereby cutting a circular pavement portion 15. The present pavement cutter 11 has a centering guide pin assembly 16 secured centrally on a lower surface of a main support frame disk 17 in place of the driver and extractor shaft 13A of the U.S. Pat. No. 8,011,851.

The centering guide pin assembly 16 of the invention, best seen in FIGS. 1-4 of the drawings, has an upper disk plate 18 with multiple annular spaced aperture lug pairs 19A, 19B, 19C and 19D there about. A central opening at 20 is provided along with a plurality of mounting bolt receiving apertures A inwardly of the perimeter edge 18A thereof as will be well understood by those skilled in the art.

Correspondingly, a lower disk plate 21 of the centering guide pin assembly 16 is configured with four annularly spaced oppositely disposed tab portions 22, each with a central aligned apertured upstanding lug 23 thereon in aligned effacing relation to the hereinbefore described lug pairs 19A, 19B, 19C and 19D. An opposing end apertured support arms 24 are pivotally secured respectively between each of the said lug pairs 19 by pivot pins 25.

Correspondingly, pairs of opposite end apertured support arms 26 are pivotally secured from each of the mounting lugs 23 by pins 27. It will be seen therefore that with the arms pairs 26 from each lug 23 are pivotally secured at their ends to corresponding aligned depending apertured support arms 24 by pins 24A forming an interlinking pivoting multi-arm assembly between the respective upper and lower disk mounting plates 16 and 19 of the centering guide pin assemblies 16.

A guide pin 28 extends from the center of the lower disk plate 22 having an apertured pin receiving mounting plate 29 secured thereto. A spaced annular surface depth engagement disk 30 is positioned on the guide pin 28 to provide a pin stop once inserted into a predrilled excavating guide bore GB in the pavement surface PS by conventional means over the utility to be accessed.

Figure 4:
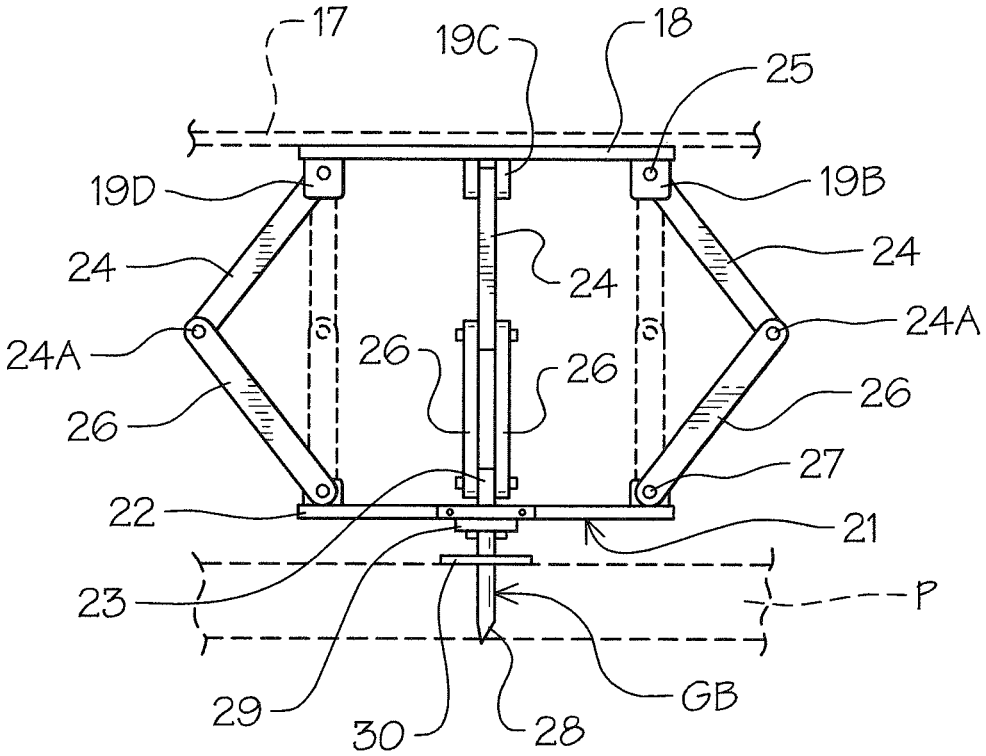
FIG. 4 is a side elevational view of the cutter's centering guide pin assembly in partially collapsed position in solid lines as the cutter advances into the pavement surface.
Figure 5:
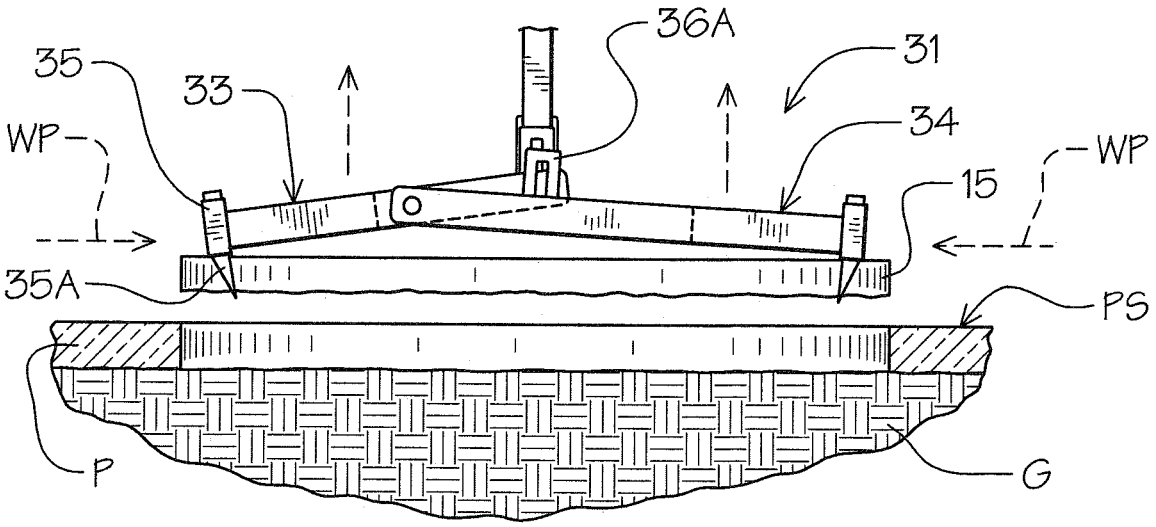
FIG. 5 is a side elevational view of a pavement "donut" engagement and lift device lifting the pavement section from the roadway after it is cut.
Figure 6:
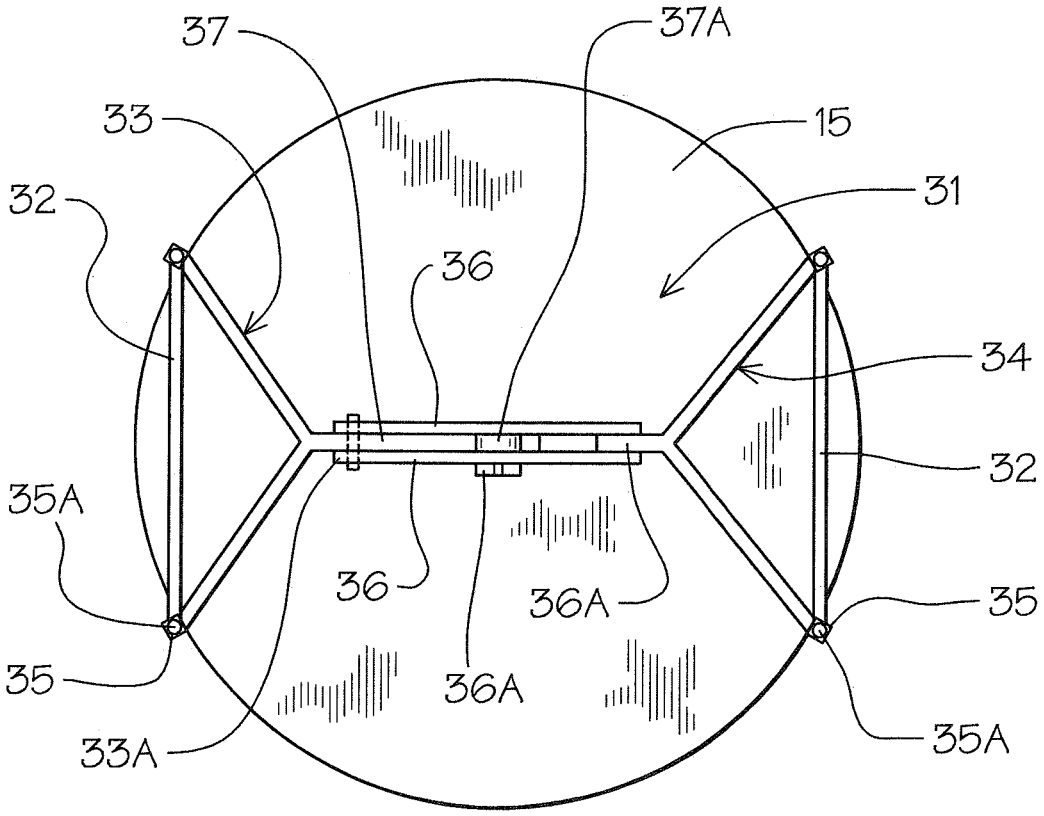
FIG. 6 is a partial top plan view thereof.

In sequence, the road surface excavation system, in use, once the guide pin 28 has been positioned within the predrilled excavating guide bore GB thereby centering the modified pavement cutter 11 which is rotated thereby engaging its multiple depending blade assemblies 14 cutting a circular path into and through the paving surface PS shown in broken lines in FIG. 1 of the drawings. As the blade assembly 14 advances, shown in broken lines, the guide pin assembly 16 will be adjustably repositioned vertically by the pivoted support arm linkage as hereinbefore described as seen in FIG. 4 of the drawings accommodating the depth of the cut through the paving surface PS. Once the cut is complete, the paver cutter 11 and guide pin assembly 16 is removed and a pavement lifting bracket 31 is fitted onto the circular pavement portion 15 as seen in FIGS. 5 and 6 of the drawings.

The lifting bracket 31 has a pair of oppositely disposed Y-shape arms 33 and 34 that each have pairs of angularly disposed end fittings 35 thereon with respective adjustable pavement disk engagement pins 35A. Cross arm support bars 32 are positioned between each end fitting 35 for stabilizing. It will be seen that the respective arms 34 are joined together and have a pair of spaced parallel arm extensions 36 extending from their adjoining point 36A an upstanding lifting limit tab 36B extends from one of the arms. The arms 33 are joined together at 33A and have a single arm extension portion 37 which extends between the arm extensions 36 with an upstanding slotted lifting tab 37A on its free end aligned with the lifting limit tab 36B. The apertured arm extensions 36 are pivoted at their respective free ends to the arm extension portion 37 by a pivot pin 38 so that when the lifting bracket 31 is lifted by its central lifting tab 37A the arm pairs 33 and 34 will pivot and apply oppositely disposed wedging engagement pressure WP to the respective pin fittings 35 with their depending pins 35A on the now defined cut out pavement portion 15 allowing same to be held in frictional engagement there between and lifted for removal as seen in FIG. 5 of the drawings.

Referring now to FIGS. 7-10 of the drawings, a lifting bracket engagement hook fitting 44 can be seen that provides for adaptable engagement and lifting rotation as will be described hereinafter.

Figure 7:
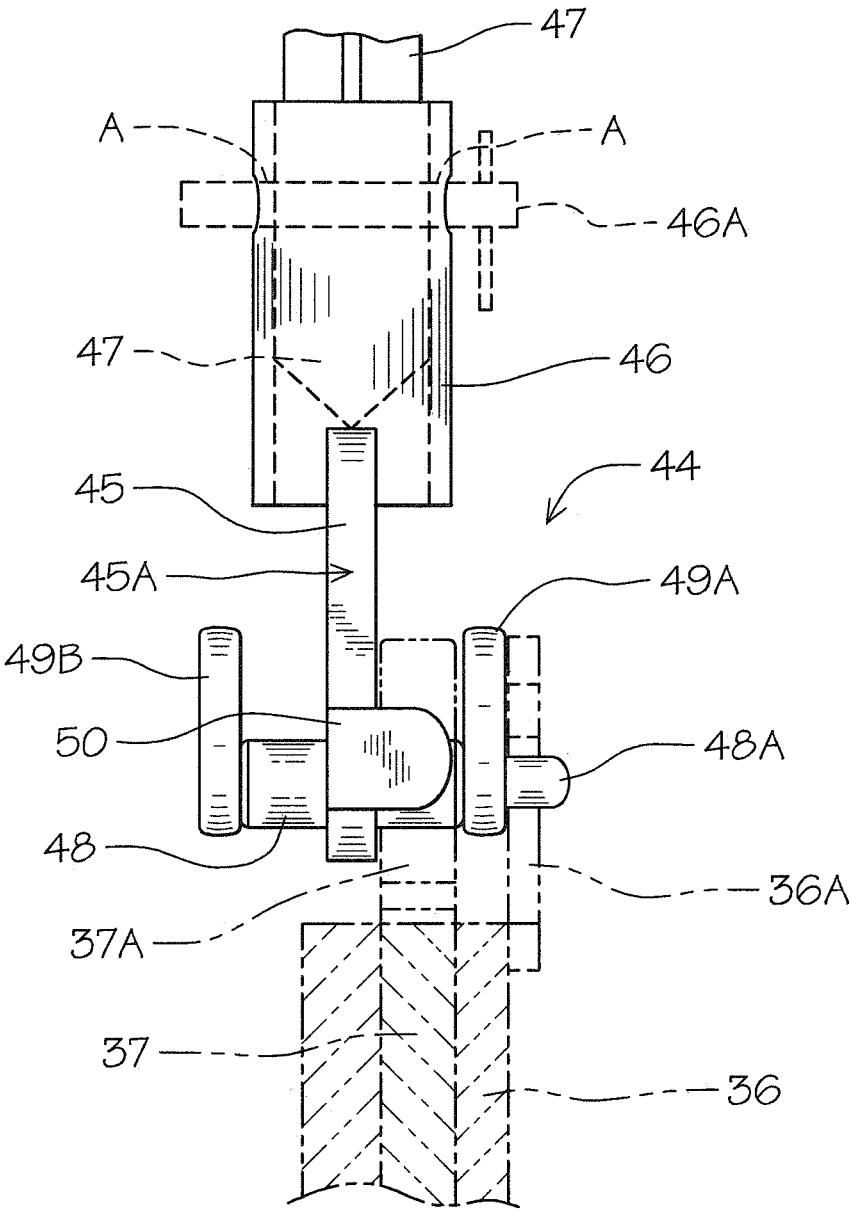
FIG. 7 is a front elevational view of lifting bracket engagement hook.
Figure 8:
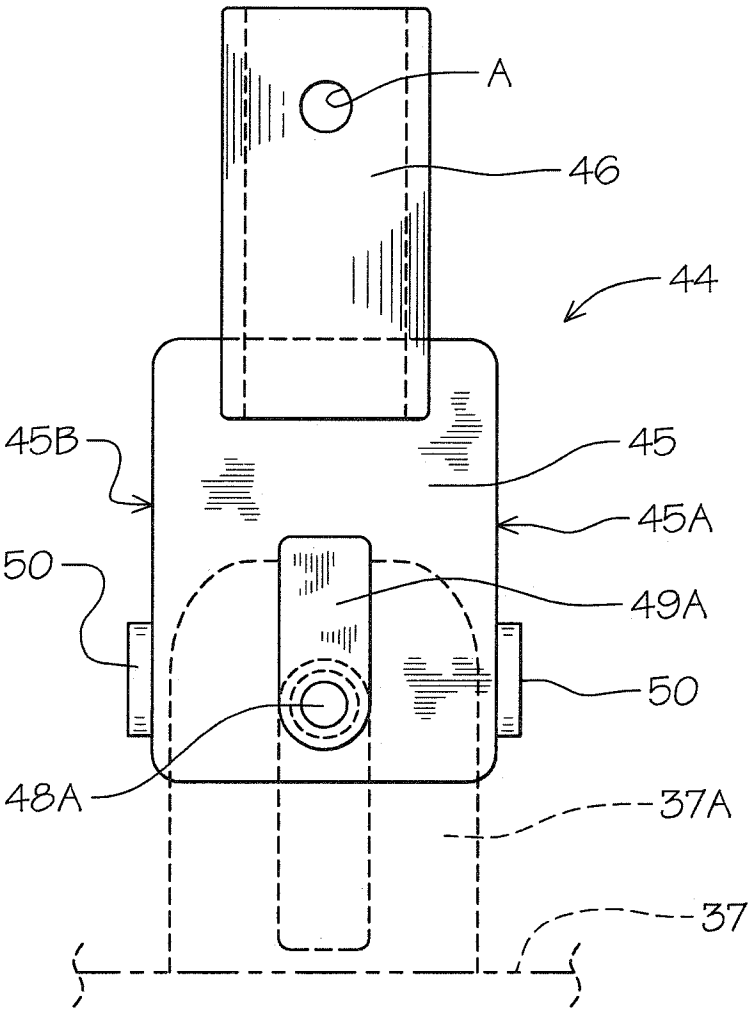
FIG. 8 is a side elevational view thereof.

The hook fitting 44 has a center support plate 45 with a cylindrical adapter 46 secured thereto extending partially therefrom, best seen in FIGS. 7 and 8 of the drawings.

The cylinder adapter 46 is apertured at A for receiving a retainment pin 46A shown in broken lines for registration through a corresponding inserted drive shaft 47 of the hydraulic power rotator HPR mounted on mobile lifting power equipment, such as a skip loader, not shown, as will be understood by those skilled in the art.

A lift bracket engagement pin 48 extends through the support plate 45 with oppositely disposed upstanding end lift tabs 49A and 49B positioned thereon in spaced relation to the planar surface of the central support plate 45. The engagement pin 48 has an extension of reduced diameter at 48A extending beyond the corresponding end lift tab 49A.

A pair of guide plates 50 are secured on the oppositely disposed parallel plate edges 45A and 45B for positional alignment of the hook fitting 44 as will be described hereinafter.

Figure 9:
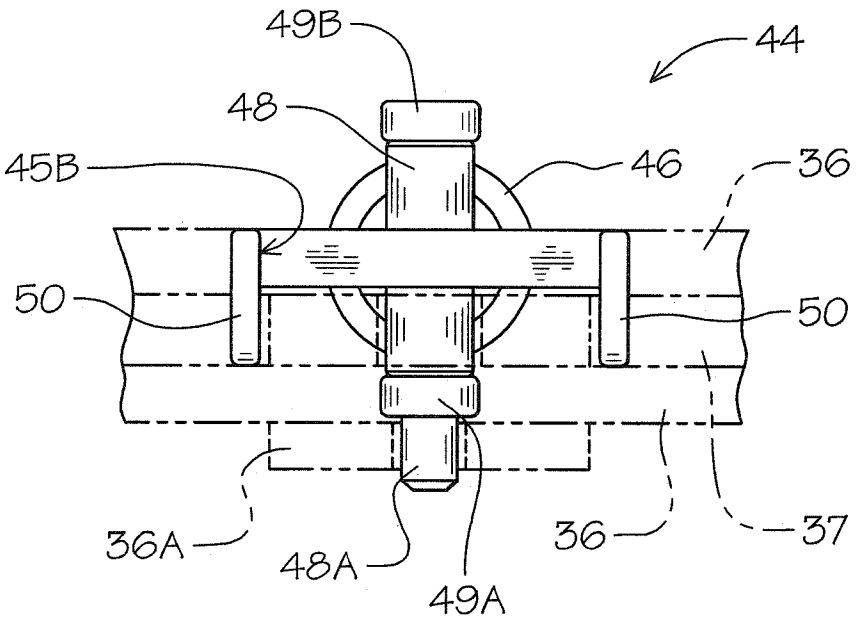
FIG. 9 is a bottom plan view thereof.

In use, the lifting bracket 31 is engaged with the hook fitting 44 by the upstanding slotted arm tab 37A shown in broken lines in FIGS. 7-9 of the drawings. The lifting tab 49A passes through the arm tab slots opening allowing for the pin 48 registration with the arm tab 37A. Once so engaged, the lifting bracket 31 can be raised by the mobile power equipment, not shown, thereby selectively engaging and holding the cut pavement portion 15 as previously described. The lifting bracket 31 can be rotated by the hydraulic power rotator HPR and transported for site removal.

The engagement pin extension 48A is provided to limit the respective arm pivot action of the lifting bracket 31 when not engaged on a pavement portion 15 by its registration within the lift limit tab 36B as seen in broken lines in FIGS. 7 and 9 of the drawings. It will be evident that given the reduced diameter at 48A of the engagement pin 48 and the slot dimension within the lifting limit tab 36B that if used while engaging a pavement portion it will not limit the lifting bracket 31 action if so required providing therefore a dual use configuration unique to its structure.

Once the pavement portion 15 is removed, a vertically segmented annular retainment box 39, as seen in FIGS. 7 and 8 of the drawings, is lifted and positioned within the now defined pavement opening PO in the pavement surface PS.

To begin excavation, a high pressure water injection excavation rod 40 which supplies water under high pressure from an auxiliary pump, not shown, as will be well understood by those skilled in the art, is then used in conjunction with a mobile vacuum excavator 41 to excavate and remove substrate within the retainment box designated area 42 as will be evident to those in the art.

As the excavation progresses, additional retainment box sections 39A, shown in broken lines, are added by position on top of one another by conventional nuts and bolts through aligned apertured mounting flanges 42 on each of the sections. It is evident that this process is continued until the utility, which in this example is a pipe 43 is exposed for repair or replacement.

The vacuum excavator 41 gathers and retains the excavated debris providing a safe, clean and effective removal and thereby access to the underground utility element as noted.

It will be evident that the above referred to method and application device of the invention has been illustrated and described and it will be apparent to those skilled in the art that various changes and modifications may be made therein without departing from the spirit of the invention.

Therefore, I claim:

1. A method of paved roadway excavation comprising, cutting and removing a disk-shaped portion of the paved roadway;

placing an annular excavation retainment box within an opening defined by paved roadway removal;

inserting a high-pressure fluid excavator into said opening;

positioning a vacuum excavator hose within said opening adjacent said fluid excavator; and removing debris from said opening by the vacuum excavation hose to a mobile vacuum source and debris retainment device while simultaneously excavating with said high pressure fluid excavator.

2. The method of paved roadway excavation set forth in claim 1 wherein removing the disk-shaped portion of paved roadway comprises, a pavement cutter having a self-adjusting centering guide pin assembly extending there from.

3. The method of paved roadway excavation set forth in claim 2 wherein said centering guide pin assembly comprises, an upper and lower disk plate, aligned engaging pivoted support arms extending between said respective disk plates and a central guide pin depending from said lower disk plate.

4. The method of paved roadway excavation set forth in claim 1 wherein removing said disk shape portion of the paved roadway comprises, a lifting bracket having oppositely disposed roadway portion engagement arms, arm extensions in parallel overlapping relation to one another pivoted together and an arm extension and lifting tab on one of said arm extensions and a lift limiting adapted tab on one of said arm extensions in alignment with said lifting tab.

5. The method of roadway excavation set forth in claim 4 wherein said lifting bracket engagement arms further comprises, angularly disposed independent material engagement pins on said respective lifting arms free ends.

6. The method of paved roadway excavation set forth in claim 1 wherein said annular excavation retainment box comprises, multiple reinforced annular sections arranged for aligned engagement one on top of the other.

7. The method of paved roadway excavation set forth in claim 6 wherein said annular sections of said excavation retainment box have apertured mounting flanges there about for registrational engagement with one another and retainment by fixation fasteners there within.

8. The method of paved roadway excavation set forth in claim 4 wherein said lifting bracket is engaged by a hook lift fitting comprising, a support plate, a lift bracket engagement pin extending from said support plate, at least one upstanding end lift tab on said engagement pin.

9. The method of paved roadway excavation set forth in claim 8 wherein said hook lift fitting further comprises, a lift pin extension of reduced diameter for selective registration within said lift limit tab extending from one of said lifting bracket arm extensions.

* * * * *